US007178177B1

(12) United States Patent
Valencia

(10) Patent No.: US 7,178,177 B1
(45) Date of Patent: Feb. 20, 2007

(54) TOILET SPLASH GUARD

(76) Inventor: JoAnn Valencia, 1005 Malibu Cyn Wy, Brea, CA (US) 92821

( * ) Notice: Subject to any disclaimer, the term of this patent is extended or adjusted under 35 U.S.C. 154(b) by 0 days.

(21) Appl. No.: 11/234,600

(22) Filed: Sep. 23, 2005

(51) Int. Cl.
*E03D 9/00* (2006.01)

(52) U.S. Cl. ..... 4/300.3

(58) Field of Classification Search ..... 4/DIG. 5, 4/300.3

See application file for complete search history.

(56) References Cited

U.S. PATENT DOCUMENTS 2,980,919 A * 4/1961 Otto et al. ..... 4/300.3
5,077,840 A * 1/1992 Masters et al. ..... 4/300.3
5,117,512 A 6/1992 Bressler
5,983,410 A 11/1999 Webster
6,357,055 B1 3/2002 Gambla et al.
2005/0193482 A1 9/2005 Gambla et al.

* cited by examiner

*Primary Examiner*—Charles E. Phillips
(74) *Attorney, Agent, or Firm*—Andrew Schroeder; The Law Office of Andrew Schroeder

(57) ABSTRACT

A toilet splash guard for use with toilets comprising: a generally flat, planar shield, the shield comprising a front side and a rear side, two ends, at least one orifice, and at least two bumpers, the front side faces the user, the two ends shaped as flanges shaped to correspond to the lower portion of a rim of a toilet, the orifice located substantially upon the upper portion of the shield, the bumpers located substantially on the lower portion of the shield, the bumpers located on the rear side of the shield, the bumpers are shaped to correspond with an upper portion of a rim of a toilet bowl.

16 Claims, 3 Drawing Sheets

TOILET SPLASH GUARD

FIELD OF THE INVENTION

The present invention deals generally with hygienic products and pertains more specifically to toilet accessories.

BACKGROUND OF THE INVENTION

One of the problems which inheres with the use of toilets is when males urinate into toilets. Every day many males experience difficulty ensuring that no urine is misplaced onto the floor, toilet seat, and other areas in a bathroom. This may be due to physical infirmities, entering a phase of potty-training, substance-abuse related issues, or poor concentration or energy. To date, there is no products in the marketplace which adequately address these issues.

Oftentimes, young boys who are just entering into the potty-training phase have difficulty ensuring all of their urine is deposited completely into the toilet and not on the floor, toilet seat cover, etc. Unfortunately, it may take weeks, if not months to properly train a young boy to successfully use the toilet for urination.

For older men it may be challenging to ensure that all of the urine is deposited into the toilet. Many older men suffer from poor balance, arthritic knees, body control, stamina, and other penile-related maladies. As a result, oftentimes urine is misplaced on the floor, toilet seat cover, etc.

Moreover, other men may experience similar problems due to injuries or other health related issues. Men whom are young and old with crutches, substance abuse-related problems, penile maladies, mental retardation, recent hospital patients, etc. may experience similar issues. Therefore, poor urination abilities are not necessarily confined in scope to just the young or infants. These issues may also afflict many men across the spectrum.

Therefore, what is clearly needed in the art is a device or article of manufacture designed specifically for the use of channeling or funneling urine into a toilet for males. Such a device should be lightweight, pliable, sanitary, and easy to use.

SUMMARY OF THE INVENTION

The present invention in some preferred embodiments consists of a toilet splash guard for use with toilets comprising: a generally flat, planar polyethylene shield, the shield comprising a front side and a rear side, two ends, two circular orifices, indicia, and three polyethylene bumpers, the front side faces the user, the two ends shaped as flanges shaped to correspond to the lower portion of a rim of a toilet, the circular orifices located substantially upon the upper portion of the shield, the bumpers located substantially on the lower portion of the shield, the bumpers located on the rear side of the shield, the bumpers are shaped to correspond with an upper portion of a rim of a toilet bowl, the left bumper and right bumper are shaped diagonally to correspond with the upper portion of a rim of a toilet, the center bumper substantially shaped as a rectangle.

Preferred embodiments may vary with the present invention. Although the aforementioned preferred embodiment was described with many components, the summary of the invention should not be construed to be limiting the scope of the present invention. Several of these components may be optional depending upon the circumstances.

BRIEF DESCRIPTION OF THE DRAWING FIGURES

DESCRIPTION OF PREFERRED EMBODIMENTS

According to a preferred embodiment of the present invention, a unique article of manufacture or device is used to prevent urine from being misplaced when aimed at a toilet. The present invention is used primarily for use with males. The article of manufacture or device is described in enabling detail below.

Figure 1:
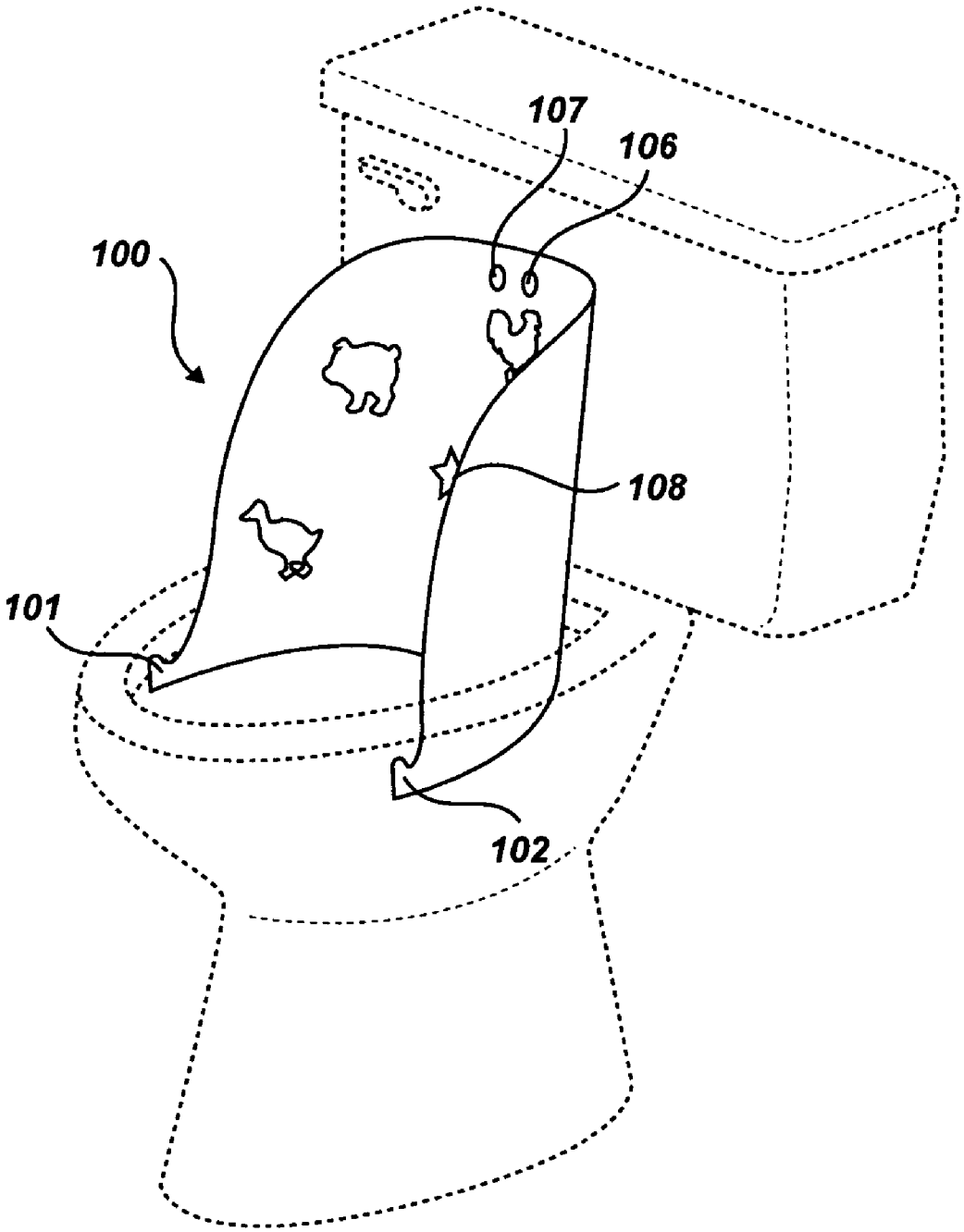
FIG. 1 is a perspective view of a preferred embodiment of the present invention.

FIG. 1 illustrates a preferred embodiment of the present invention. The toilet splash guard 100 is a generally flat, planar, and bell shaped device which is pliable enough in order to fit into a toilet bowl. In its general use, the toilet splash guard 100 is placed in a similar fashion as seen in FIG. 1. When a male urinates, the toilet splash guard 100 channels or funnels the urine into the toilet, thus eliminating unsightly urine from being misplaced throughout a bathroom. The toilet splash guard 100 can be generally described as a shield, or a urine shield.

The toilet splash guard 100 will be described herein by different regions and/or parts thereof. The toilet splash guard 100 is comprised of a left rim edge 101, a right rim edge 102, a left bumper 103, a center bumper 104, a right bumper 105, a right hole 106, a left hole 107, and indicia 108.

The toilet splash guard 100 is generally a one-piece device or article of manufacture. The only pieces or components which may be added or subtracted are the left bumper 103, the center bumper 104, the right bumper 105, the left hole 107, the right hole 106, and the indicia 108.

The toilet splash guard 100 in a preferred embodiment is made of a flexible, thin, low-density, plastic polyethylene. There are many reasons why polyethylene is an expedient material to comprise a preferred embodiment of the present invention. First, polyethylene is very pliable when cut into relatively thin sheets. In terms of the present invention, relatively thin shall mean a thickness of less than an inch. This is important because the present invention calls for the user to bend the toilet splash guard 100 in such a way to fit into the rim of a toilet bowl. One advantage of the present invention is the fact that the flat and planar toilet splash guard 100 may fit into almost any sized and shaped toilet bowl because the pliability of the toilet splash guard 100 enables it to conform to the rim of just about any toilet bowl. Moreover, when the toilet splash guard 100 is not in use, it may be flattened and stored in a relatively small space.

Another advantage of polyethylene as it relates to the present invention is the fact that it is a sanitary material which can withstand harsh chemicals. Generally, a user will disinfect and spray the toilet splash guard 100 in order to remove residual urine and to remove the malodorous smells associated with urine.

Yet another advantage of using polyethylene is the fact that it is soft to the touch. This is important because one of the objects of the present invention is to enable young children to use the toilet splash guard for their own personal use. Other materials may be too coarse and produce sharp and jagged edges which may create a safety issue.

Although the use of polyethylene is strongly recommended for use with the present invention, other expedient materials may also be used which incorporate the same or similar inherent characteristics mentioned above. Although the inventor is not aware of such substitute materials, it is foreseeable that such materials may be available. As such, the present invention should not be construed to be limiting in scope with respect to the types of materials which are used to comprise the present invention.

Turning now to the present invention, left rim edge 101 and right rim edge 102 are essentially flanges which are used to cooperate with the underside of a rim of a toilet bowl. These two flanges facilitate the affixation of the toilet splash guard 100 to the rim of a toilet bowl.

Figure 2:
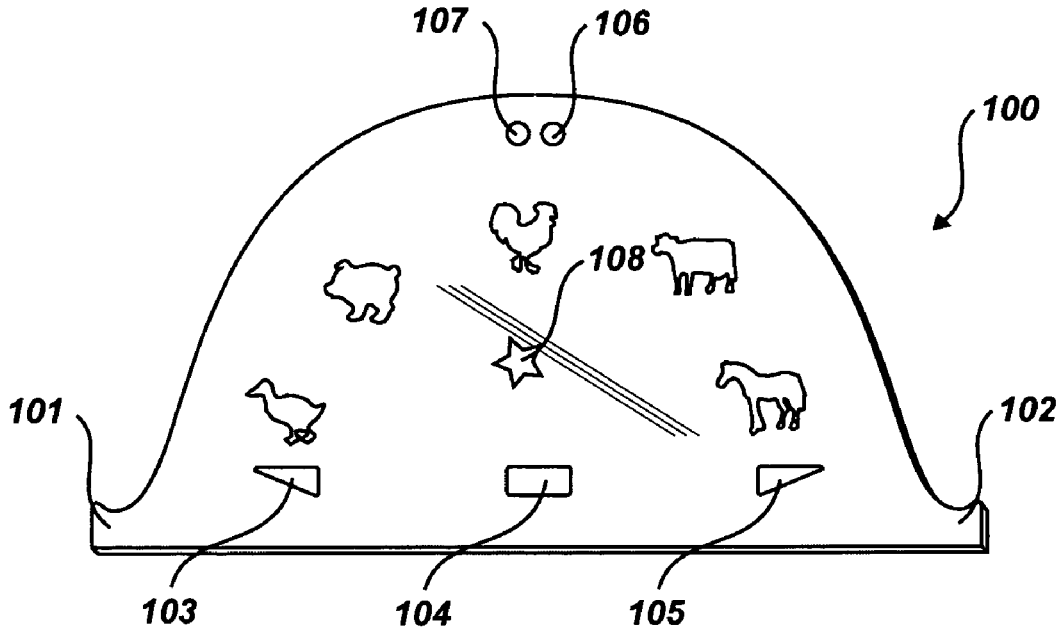
FIG. 2 is a planar view of a preferred embodiment of the present invention.
Figure 4:
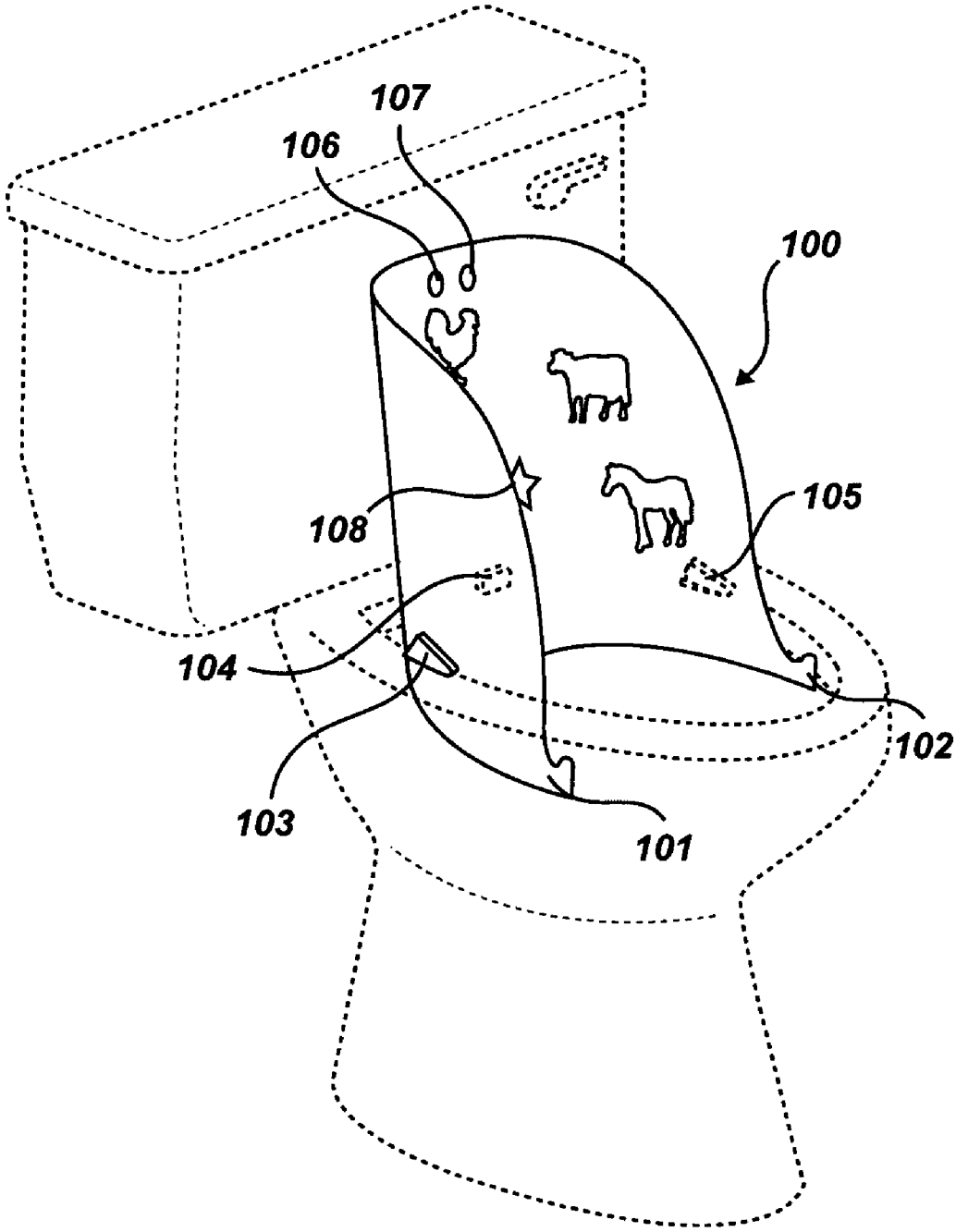
FIG. 4 is a perspective view of a preferred embodiment of the present invention.

The left bumper 103, the center bumper 104, and the right bumper 105 are used to further facilitate the affixation of the toilet splash guard 100 with the toilet bowl. Whereas the flanges are positioned on the underside of a rim of a toilet bowl, the bumpers are positioned on the upper surface of the rim of a toilet bowl as illustrated in FIG. 4. Both the left bumper 103 and the right bumper 105 are both cut at an angle as illustrated in FIG. 2. The reason the left bumper 103 and the right bumper 105 are cut at angles is because as a user bends the toilet splash guard 100 to fit into the rim of a toilet bowl, the bumpers will necessarily contact the rim at an angle. The center bumper 104 is cut straight. The center bumper 104 appears as a box.

The left bumper 103, the center bumper 104, and the right bumper 105 are also made of polyethylene. Since polyethylene is not a material well adaptive for use with adhesives, the bumpers are affixed to the outside of the toilet splash guard 100 through heat welding. Essentially the bumper pieces are melted onto the toilet splash guard 100 as cut extrusions. Since the methods used to affix the bumpers onto the toilet splash guard are well known to one skilled in the art, other methods used will not be further detailed herein.

Figure 3:
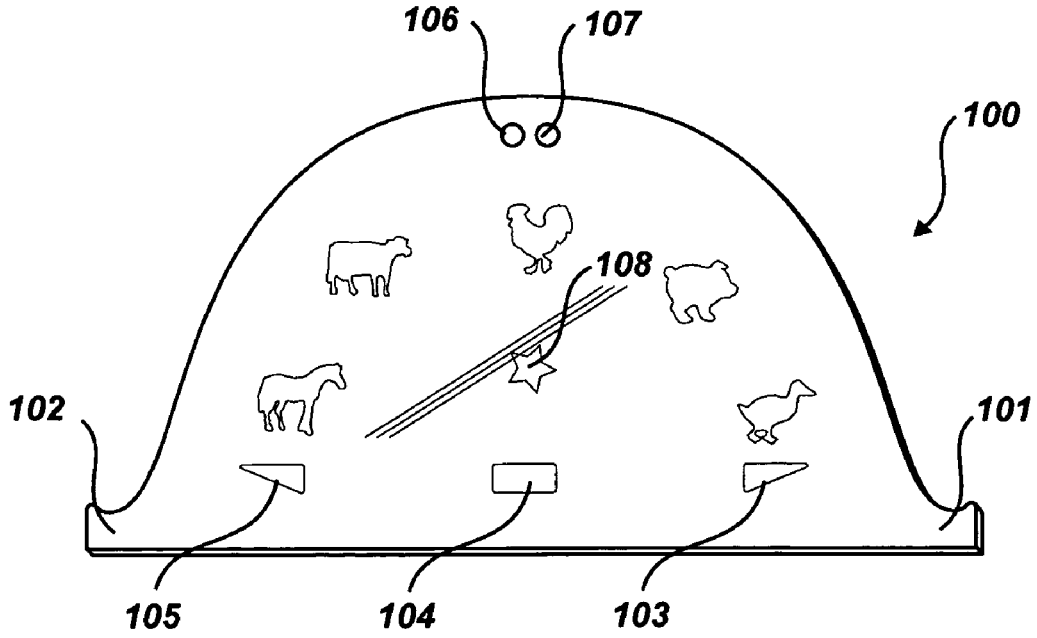
FIG. 3 is a planar view of a preferred embodiment of the present invention.

It should be pointed out here that the bumpers are only affixed to one side of the toilet splash guard 100 as illustrated in FIG. 2. FIG. 3 illustrates the opposite side of the toilet splash guard which does not have the bumpers. For this reason, the toilet splash guard is bent or flexed by the user inwards such that the bumpers are on the outside such that it may be placed upon the upper surface of the rim of a toilet bowl.

Right hole 106 and left hole 107 are used for the purpose of handling the toilet splash guard. The holes may be thought of as handles. Although the illustrated preferred embodiment discloses the use of holes on the top of the toilet splash guard 100, the use of holes is not specifically required by the present invention. There abound a panoply of different ways of fashioning a handle for the present invention. Therefore, the present invention should not be construed as limiting in scope with respect to the use of holes.

Indicia 108 may embody a panoply of different functions. Indicia 108 may be used as a training device in order to teach young boys in potty training to aim their urine a cartoon character or the like. Games may be incorporated challenging the young boys to aim their urine in specific areas of the toilet splash guard 100.

In some preferred embodiments indicia 108 may embody static cling vinyl characters. However, there also abound a panoply of ways to imprint or affix indicia 108 to the toilet splash guard 100 which are well known to one skilled in the art. As such, the other methods of affixation of indicia 108 to the toilet splash guard shall not be further detailed herein.

Indicia 108 may also be used for marketing or ornamental purposes. Or, in the alternative indicia 108 may comprise aphorisms, precepts, ideas, or fanciful characters and objects. The uses and embodiments of indicia 108 are endless. However, the use of indicia 108 is not necessary for use with the present invention. In other preferred embodiments, the use of indicia 108 may not be necessary. As such, the present invention should not be construed to be limiting in this regard.

It will be apparent to the skilled artisan that there are numerous changes that may be made in embodiments described herein without departing from the spirit and scope of the invention. As such, the invention taught herein by specific examples is limited only by the scope of the claims that follow.

What is claimed is:

1. A toilet splash guard for use with toilets comprising: a generally flat, flexible, planar shield, the shield comprising a front side and a rear side and two ends, the front side faces the user, the two ends are shaped as flanges to correspond to the lower portion of a rim of a toilet bowl, the bumpers are located substantially on the lower portion of the shield, the bumpers are located on the rear side of the shield, the bumpers are shaped to correspond with an upper portion of a rim of a toilet bowl wherein the shield comprises at least two bumpers, a left bumper and a fight bumper, the left and right bumpers shaped at an angle to correspond to the upper portion of the rim of a toilet bowl when the flexible guard is bent into the shape of the bowl.

2. The toilet splash guard of claim 1 wherein the shield comprises two orifices.

3. The toilet splash guard of claim 1 wherein the shield is comprised of polyethylene.

4. The toilet splash guard of claim 1 further comprising indicia.

5. The toilet splash guard of claim 1 wherein the bumpers are affixed to the rear side of the shield by heat welding.

6. The toilet splash guard of claim 4 wherein the indicia is comprised of static cling vinyl characters.

7. The toilet splash guard of claim 2 wherein the shield is comprised of polyethylene.

8. The toilet splash guard of claim 4 wherein the shield is comprised of polyethylene.

9. The toilet splash guard of claim 5 wherein the shield is comprised of polyethylene.

10. The toilet splash guard of claim 6 wherein the shield is comprised of polyethylene.

11. A toilet splash guard for use with toilets comprising: a generally flat, planar shield, the shield comprising a front side and a rear side, two ends, two circular orifices, indicia, and three bumpers, the front side faces the user, the two ends shaped as flanges shaped to correspond to the lower portion of a rim of a toilet, the circular orifices located substantially upon the upper portion of the shield, the bumpers located substantially on the lower portion of the shield, the bumpers located on the rear side of the shield, the bumpers are shaped to correspond with an upper portion of a rim of a toilet bowl, the left bumper and right bumper are shaped diagonally to correspond with the upper portion of a rim of a toilet, the center bumper substantially shaped as a rectangle.

12. The toilet splash guard of claim 11 wherein the shield is comprised of polyethylene.

13. The toilet splash guard of claim 11 wherein the bumpers are comprised of polyethylene.

14. The toilet splash guard of claim 11 wherein the indicia is comprised of static cling vinyl characters.

15. The toilet splash guard of claim 11 wherein the shield has a thickness of less than one inch.

16. A toilet splash guard for use with toilets comprising: a generally flat, planar polyethylene shield, the shield comprising a front side and a rear side, two ends, two circular orifices, indicia, and three polyethylene bumpers, the front side faces the user, the two ends shaped as flanges shaped to correspond to the lower portion of a rim of a toilet, the circular orifices located substantially upon the upper portion of the shield, the bumpers located substantially on the lower portion of the shield, the bumpers located on the rear side of the shield, the bumpers are shaped to correspond with an upper portion of a rim of a toilet bowl, the left bumper and right bumper are shaped diagonally to correspond with the upper portion of a rim of a toilet, the center bumper substantially shaped as a rectangle.

* * * * *